US005212342A

United States Patent [19]

Eches et al.

[11] Patent Number: 5,212,342

[45] Date of Patent: May 18, 1993

[54] CONTAINER FOR RECEIVING PROPELLANT CHARGES

[75] Inventors: Nicolas Eches; Bernard Brion, both of Bourges, France

[73] Assignee: GIAT Industries, Versailles, France

[21] Appl. No.: 833,126

[22] Filed: Feb. 10, 1992

[30] Foreign Application Priority Data

Feb. 11, 1991 [FR] France ..... 91 01499

[51] Int. Cl.[5] ..... F42B 3/02

[52] U.S. Cl. ..... 102/317; 206/509; 403/300

[58] Field of Search ..... 403/300; 229/DIG. 11; 206/509; 102/317, 331

[56] References Cited

U.S. PATENT DOCUMENTS

| | | | |
|---|---|---|---|
| 2,358,795 | 9/1944 | Djidics et al. | 102/317 |
| 2,415,422 | 2/1947 | Fogg | 102/317 |
| 2,735,704 | 2/1956 | Löfqvist | 403/300 |
| 2,857,844 | 10/1958 | Lagemann | 102/317 |
| 2,865,290 | 12/1958 | Bonsper | 102/317 |
| 2,887,953 | 5/1959 | Mager | 102/317 |
| 5,125,226 | 6/1992 | Sperinck | 403/300 |

FOREIGN PATENT DOCUMENTS

| | | |
|---|---|---|
| 341270 | 5/1989 | European Pat. Off. . |
| 8634491.9 | 12/1986 | Fed. Rep. of Germany . |
| 8804573.0 | 4/1988 | Fed. Rep. of Germany . |
| 2098668 | 2/1972 | France . |
| 2136929 | 9/1984 | United Kingdom . |

*Primary Examiner*—David H. Brown
*Attorney, Agent, or Firm*—Oliff & Berridge

[57] ABSTRACT

The field of invention is containers able to receive a propellant charge. A container (1, 12, 13) according to the invention, which is designed to be joined to another container at one of its end faces is characterized by the joining means having on the one hand a ring disposed on a constricted area provided at one end of the container, the ring being slidable axially to cover a second constricted area provided on the other container, and on the other hand having hooking device disposed on at least one of the container and the other container at the end faces designed to come in contact with each other.

20 Claims, 5 Drawing Sheets

CONTAINER FOR RECEIVING PROPELLANT CHARGES

The field of the present invention relates to containers that can receive a propellant charge, particularly containers used in the field of large-caliber or tank artillery.

In order to adjust the firing range, it is often necessary to modify the quantity of powder used to fire a projectile.

Modular, substantially cylindrical containers made of combustible material have already been designed. Because of their rigidity, such containers are easier to use than traditional powder bags.

In order to reduce the size of munitions inside armored vehicles, it may also be necessary to divide them into two separate parts, one carrying the main propellant charge and the other carrying the projectile, possibly plus a secondary propellant charge (see for example patent GB2,136,929 which describes such munitions).

In all cases, the question of joining several containers together may be raised.

It may in fact be useful to accelerate loading by introducing all the containers in a single maneuver, for example by means of an automatic loading device.

In this case, it is essential to join the containers together, conferring some rigidity on the assembly.

Moreover, it may prove necessary rapidly to withdraw the charge already introduced into the chamber of a weapon, and if the total charge is divided into several batches, this withdrawal is made more time consuming and more difficult.

Patent EP 341270 proposes fully symmetrical containers having constricted areas at both ends. It is possible to join two or more containers together with the aid of a ring whose dimension in a direction of an axial length of the container is essentially equal to twice the length of the constricted areas.

This arrangement has a number of disadvantages. Assembly is complicated by the fact that the ring has to be set in place on one of the containers before the second container is positioned in the ring.

Indeed, the ring cannot be left on the container because by remaining on the endmost container (projectile side) it would pointlessly increase the total volume of the charge. Moreover, it would run the risk of being damaged during handling.

In addition, the rigidity of the assembly depends essentially on the tightness of the fit of the ring on the constricted areas, said tightness itself depending on the degree of the deformation of the lateral surface of the constricted area by the ring which has convexities on it.

Such a configuration is unsuitable for charges whose weight may be on the order of ten or so DaN (as in the case of charges for tank munitions).

There is thus a risk of the charges being misaligned axially which can cause mishaps when the assembly is introduced into the chamber, particularly if this is done by an automatic loading device.

SUMMARY OF THE INVENTION

The goal of the present invention is to propose a container that can be easily and rapidly joined to other containers.

The invention applies both to the creation of modular charges and to charges made of at least two batches, one comprising the main charge and its ignition tube and the other, the projectile (and possibly, but not necessarily, a secondary charge).

Thus, the object of the invention is a container, particularly for a propellant charge, which is designed to be joined to another container by one of its end faces, this container being characterized by the joining means comprising on the one hand a ring disposed on a constricted area provided at one end of the container, said ring being slidable axially to cover a second constricted area provided on the other container, and on the other hand, securing means provided on one and/or the other container at the end face designed to come in contact with each other.

The ring ensures alignment of the containers as well as the flexural rigidity of the assembly. The securing means ensures the axial linking of the containers.

The ring also improves the holding of the securing means by protecting them from any shear stress.

According to another characteristic, the ring can occupy a first position wherein it is recessed relative to the respective end face of the container, as well as a second position in which it projects beyond this end face.

This prevents damage to the ring which can thus be left in place on the container.

According to another characteristic, means for locking the ring in position axially relative to the container are provided.

These locking means, may comprise at least two elastic tongues integral with the container at the level of the generatrices of the constricted area bearing the ring and distributed angularly regularly relative to the container, these tongues being able to form a stop immobilizing the ring in its second position.

Advantageously, the ring has holes which the elastic tongues enter when the ring is in its first position.

According to one particular embodiment, the securing means comprise self-gripping elements.

The container according to the invention may be of the modular type in which case it has a constricted area at each of its ends, the constricted areas being of different lengths and the ring being disposed on the longer constricted area.

In the latter case, it will be advantageous to provide one self-gripping element on one end face and a second self-gripping element of the matching type on the second end face.

The container according to the invention may also constitute the base container or the projectile-carrying container of a charge composed of at least two batches.

BRIEF DESCRIPTION OF THE DRAWINGS

The invention will be better understood from reading the description of particular embodiments, said description referring to the attached drawings wherein.

DETAILED DESCRIPTION OF PREFERRED EMBODIMENTS

Figure 1:
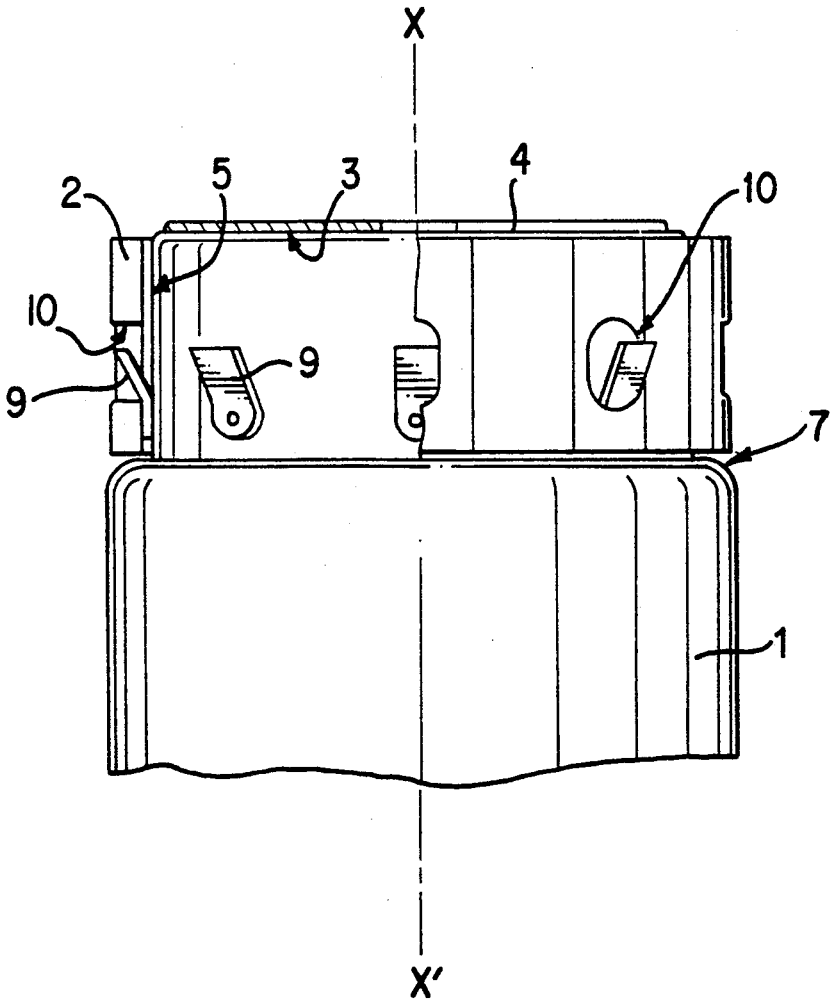
FIGS. 1 and 2 represent the relative ends of two containers according to the invention before and after they are joined together

With reference to FIG. 1, one end of container 1 according to the invention is represented schematically and partially. This container is made in known fashion of a combustible material such as nitrocellulose or cardboard; it contains a propellant charge in the grain or stick form, not shown here, possibly in addition to one or more ignition compositions.

A constricted area 5 is provided at this end and it has a ring 2 also made of a combustible material. To facilitate the description, the ring is shown in section in the left half of FIG. 1.

The outside diameter of the ring is essentially equal to that of the container itself.

A number of elastic tongues 9, made of spring steel for example, are rendered integral with the container for example by riveting at the level of the generatrices of constricted area 5.

These tongues are regularly distributed angularly relative to the container and enter holes 10 in ring 2.

The ring can slide relative to container 1 in the axial direction XX'. The elasticity of tongues 9 keeps the ring in its first position as shown in FIG. 1, namely abutting shoulder 7 which separates constricted area 5 of the body from container 1.

End face 3 of the container, in the particular embodiment described here, has a securing means 4 which may be adhesive paper for example.

Ring 2 and securing means 4 constitute means that allow this first container to be joined to another container which may or may not be similar to the first.

In its first position shown in FIG. 1, the ring is recessed relative to end face 3 of container 1; such an arrangement has the advantage of preventing damage to the ring as a result of container handling.

Figure 2:
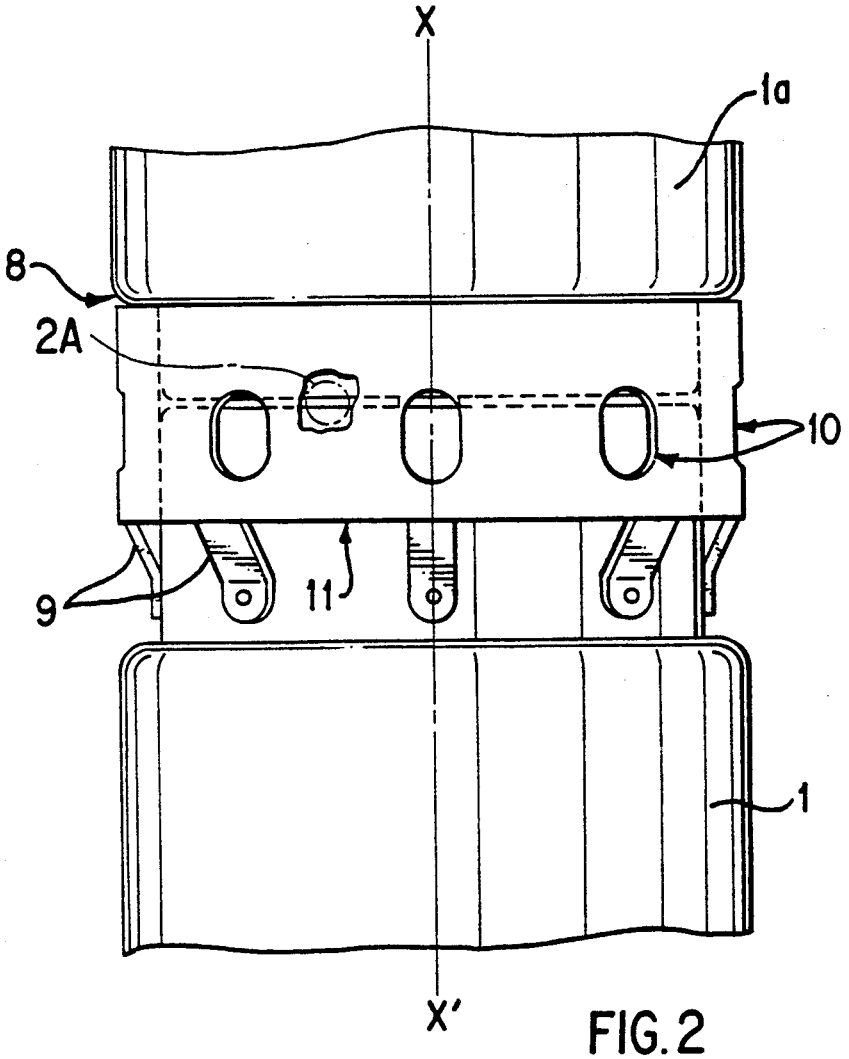

FIG. 2 shows container 1 above joined to another container 1*a* by the joining means described above.

The ring occupies a second position wherein it projects beyond end face 3 (shown in dotted lines).

Thus it covers a second constricted area provided on the other container 1*a* and abuts a shoulder 8 of the latter.

End face 3 of container 1 is in contact with the end face of container 1*a*, with securing means between these two faces ensuring axial joining of the two containers.

Hence it is possible to extract the assembly composed of the two containers from the chamber of a weapon.

The fact that the ring is in contact with the constricted areas of the two containers ensures the flexural strength of the assembly and also improves the retention of the securing means by preventing any shear stress.

The ring does not participate directly in the axial hooking of the containers so that misalignments found in the system according to the prior art, in which a ring causes point deformations in the constricted areas, are avoided.

In the second position of the ring shown in FIG. 2, elastic tongues 9 abut rear face 11 of the ring. Thus the tongues ensure axial locking of the ring in its second position which makes the assembly reliable.

Preferably, the dimensions of the component parts of the containers and the joining means are chosen such that the ring abuts shoulder 8 of second container 1*a* when tongues 9 themselves abut rear face 11 of the ring. This totally immobilizes the ring axially.

In practice, it is found that it is necessary for the contacted area of container 1*a* to be shorter than that carrying the ring.

Figure 5:
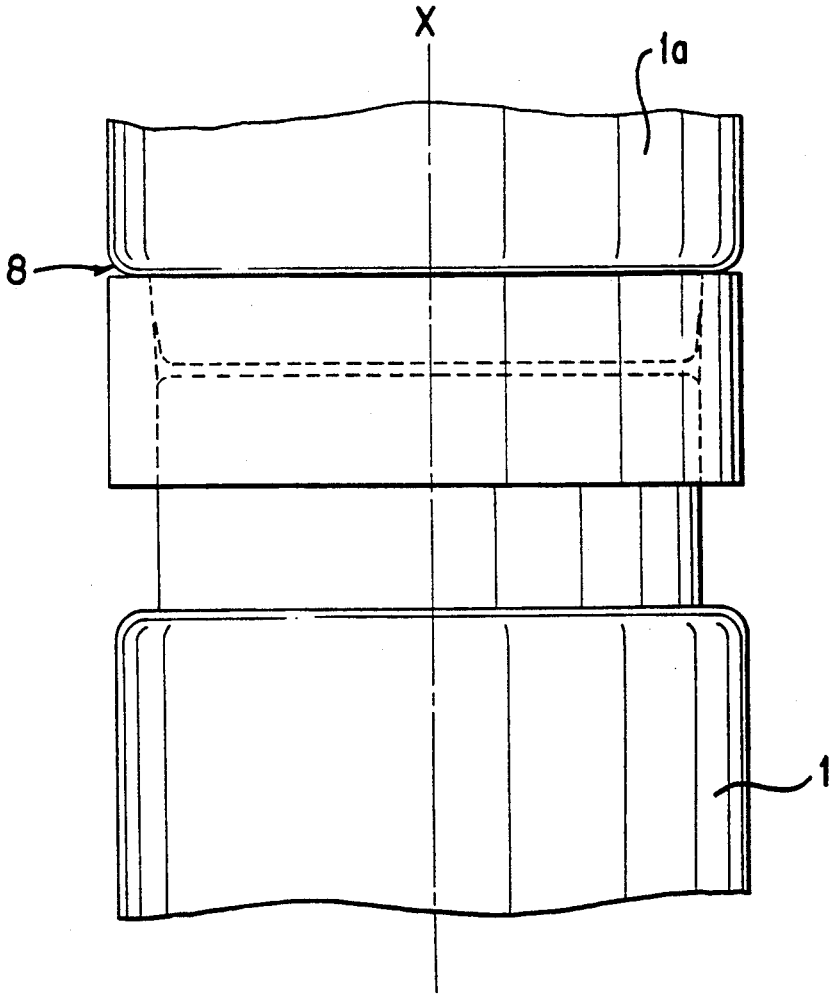
FIG. 5 represents an alternative embodiment of the invention.

It would be possible to replace the elastic tongues by a slight relative taper of the ring and the constricted area of second container 1*a* as shown in FIG. 5.

According to one alternative embodiment, the securing means may comprise an adhesive paper on second container 1*a*, with the first container bearing only the ring.

Figure 2A:
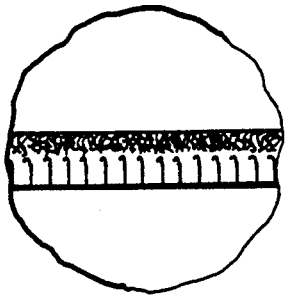
FIG. 2A shows a close-up view of one type of securing means of the present invention.

According to another embodiment, the securing means may advantageously be composed of self-gripping elements (for example s hook and loop fastener such as Velcro (registered trademark), one element being disposed on the end face of container 1 and another element of a matching type being disposed on the end face of container 1*a*. FIG. 2A illustrates this embodiment.

In all cases, the securing means preferably have the shape of a crown in order to leave the axis of the container clear. The purpose of this is to facilitate transmission of ignition from one container to the other.

Figure 3:
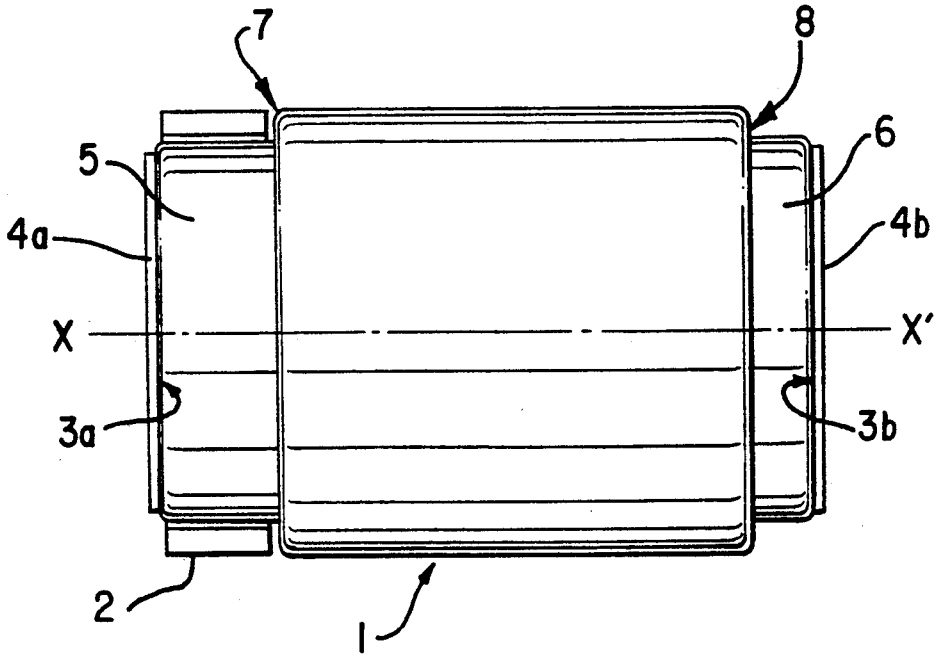
FIG. 3 represents a container of the modular type according to the invention.

FIG. 3 shows a container of a modular type according to the invention. This container, made of combustible material, is designed to be joined to other containers that are completely identical thereto.

Thus, it has one constricted area at each of its ends, constricted areas 5 and 6 being of different lengths, and ring 2 (shown in cross section, the tongues not being shown) is disposed on longer constricted area 5.

End faces 3*a*, 3*b* have self-gripping securing elements 4*a*, 4*b*. Self-gripping element 4*a* is of the type that matches element 4*b*.

Thus it is possible to assemble several containers 1 in order to create charges of a given power. Such a container is particularly suitable for field artillery.

Figure 4:
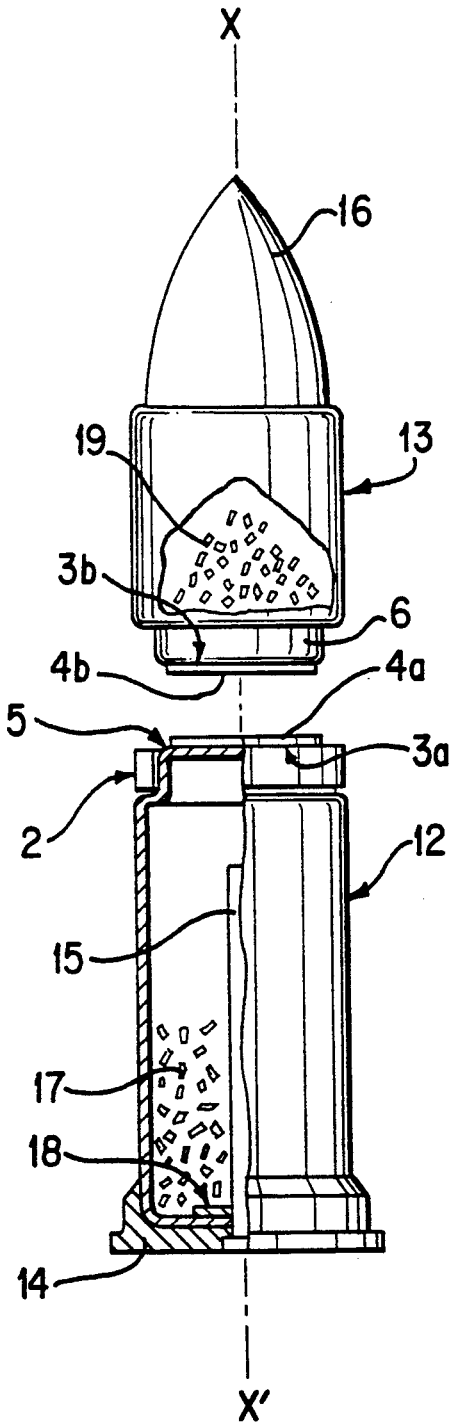
FIG. 4 represents a two-batch load comprising a base container and a projectile-bearing container according to the invention.

FIG. 4 shows two containers according to the invention constituting a two-batch charge, for example for an armored vehicle. This charge comprises a base container 12 (shown in half cross section) which has a case 14, made of metal for example, and an ignition tube 15, and which contains a propellant charge 17.

It also has a projectile-bearing container 13 which in this case contains a propellant charge 19 and possibly a composition for igniting the latter with a projectile 16 of known type (explosive, flechette, or the like) mounted on said charge.

Depending on ballistic requirements, it would also be possible to design a projectile-bearing container that did not have a propellant charge.

In this particular embodiment, base container 12 bears ring 2 on a constricted area 5 as well as a self-gripping securing element 4*a* on end face 3*a* (the ring's axial locking means are of the type described above but are not shown here to simplify the figure).

Projectile-bearing container 13 has a constricted area 6 (preferably shorter than constricted area 5 of the base container) and bears a self-gripping securing element 4*b* of the type matching element 4*a* on end face 3*b*. According to another embodiment (not shown here) it is possible to provide a projectile-bearing container on which the ring is disposed, whereby the base container has a short constricted area and a self-gripping element.

According to other embodiments, the self-gripping elements can be replaced by one or more adhesive sheets disposed on one or both of the containers.

What is claimed is:

1. A container having a first constructed area and a first end face at a first end to be made integral with an abutting container having a second constricted area and a second end face at a second end, the container comprising a ring and securing means, the ring being disposed on the first constricted area so as to be axially slidable to cover the second constricted area, the securing means being disposed on the first end face for joining the container and the abutting container.

2. The container of claim 1, wherein the ring is axially slidable between a first position and a second position, the first position being where the ring is recessed relative to the first end face and the second position being where the ring projects beyond the first end face.

3. The container of claim 1, wherein the container further has an additional constricted area t an opposite end opposite to the first end, an axial length of the first constricted area being longer than an axial length of the additional constricted area.

4. The container of claim 1, wherein the container is a base container for holding one batch of a charge comprising at least two batches.

5. The container of claim 1, wherein the container is a projectile-bearing container holding one batch of a charge comprising at least two batches.

6. The container of claim 1, further comprising at least one lock for axially locking an axial position of the ring relative to the container.

7. The container of claim 6, wherein the lock comprises a plurality of elastic tongues integral with the container at a position of generatrices of the first constricted area, the plurality of elastic tongues being regularly distributed about a perimeter of the container and forming a stop which immobilizes the ring in an extended position.

8. The container of claim 7, wherein the ring has a plurality of holes therein, each hole corresponding to and being entered by a respective tongue of the plurality of elastic tongues so that the ring may be retained in a retained position.

9. A container arrangement comprising a first container having a first constricted area and a first end face at a first end and an abutting second container having a second constricted area and a second end face at a second end, the first container comprising a ring being disposed on the first constricted area so as to be axially slidable to cover the second constricted area, the container arrangement further comprising a securing means being disposed on at least one of the first end face and the second end face for joining the first container and the abutting second container.

10. The container arrangement of claim 9, wherein the ring is axially slidable between a first position and a second position, the first position being where the ring is recessed relative to the first end face and the second position being where the ring projects beyond the first end face.

11. The container arrangement of claim 9, wherein the first container further has an additional constricted area to an end opposite to the first end, an axial length of the first constricted area being longer than an axial length of the additional constricted area.

12. The container of claim 9, wherein the securing means comprises self-gripping elements.

13. The container of claim 12, wherein the self-gripping elements comprise a first gripping element disposed on the first end face for gripping second gripping element disposed on the second end face.

14. The container arrangement of claim 9, wherein the first container is a base container for holding one batch of a charge comprising at least two batches.

15. The container of claim 14, wherein the abutting second container is a projectile-bearing container holding another batch of the charge.

16. The container arrangement of claim 9, wherein the first container is a projectile-bearing container holding one batch of a charge comprising at least two batches.

17. The container of claim 16, wherein the abutting second container is a base container holding another batch of the charge.

18. The container arrangement of claim 9, further comprising at least one lock for axially locking an axial position of the ring relative to the first container.

19. The container arrangement of claim 18, wherein the lock comprises a plurality of elastic tongues integral with the first container at a position of generatrices of the first constricted area, the plurality of elastic tongues being regularly distributed about a perimeter of the first container and forming a stop which immobilizes the ring in an extended position.

20. The container arrangement of claim 19, wherein the ring has a plurality of holes therein, each hole corresponding to and being entered by a respective tongue of the plurality of elastic tongues so that the ring may be retained in a retained position.

* * * * *